United States Patent [19]

Anderson et al.

[11] 4,132,858

[45] Jan. 2, 1979

[54] GRADED INSULATION CABLE CONSTRUCTION, AND METHOD OF OVERCOMING STRESSES THEREIN

[75] Inventors: Harry C. Anderson, Stratford; Burton T. MacKenzie, Jr., Monroe; Maurice Prober, Fairfield, all of Conn.; Nirmal Singh, Lenox, Mass.

[73] Assignee: General Electric Company, New York, N.Y.

[21] Appl. No.: 781,888

[22] Filed: Mar. 28, 1977

Related U.S. Application Data

[63] Continuation-in-part of Ser. No. 643,931, Dec. 23, 1975, abandoned.

[51] Int. Cl.[2] ..... H01B 7/02

[52] U.S. Cl. ..... 174/120 SR; 29/624; 174/120 R; 174/120 SC

[58] Field of Search ..... 174/120 R, 120 SR, 121 R, 174/120 SC; 29/624

[56] References Cited

U.S. PATENT DOCUMENTS

| | | | |
|---|---|---|---|
| 2,717,917 | 9/1915 | Isenberg | 174/121 R |
| 3,433,891 | 3/1969 | Zysk | 174/120 R |
| 3,711,631 | 1/1973 | Denes | 174/120 R |

FOREIGN PATENT DOCUMENTS

| | | | |
|---|---|---|---|
| 1568 of | 1901 | United Kingdom | 174/120 R |

*Primary Examiner*—E. A. Goldberg
*Attorney, Agent, or Firm*—R. G. Simkins; P. L. Schlamp

[57] ABSTRACT

An electrical cable having an improved graded insulation which minimizes uneven electrical stresses caused therein by a lack of a symmetrical cable structure, and a method of overcoming disproportionate electrical stresses at interfaces intermediate the sections of a graded insulation for electrical cable.

24 Claims, 2 Drawing Figures

GRADED INSULATION CABLE CONSTRUCTION, AND METHOD OF OVERCOMING STRESSES THEREIN

This is a continuation-in-part of application Ser. No. 643,931, filed Dec. 23, 1975, and now abandoned.

BACKGROUND OF THE INVENTION

The grading of dielectric insulations for electrical cables for relative high voltage service comprising the introduction of predetermined gradations of dielectric characteristics in a body or unit of dielectric insulation enclosing an electrical conductor is an old concept and subject in the electrical art. For instance, various aspects and means of grading electrical insulation for cable are proposed and/or disclosed in a paper entitled "Silicone Rubber Graded Construction for High Voltage Insulation", by S. J. Nizinski, published in *Wire and Wire Products*, Volume 3, No. 5, May, 1972, page 628 et seq., and in British Pat. No. 1568 of 1901 and the following U.S. Pat. Nos.: 1,802,030, 2,123,746, 2,198,977, 3,160,703, 3,287,489, 3,433,891, 3,711,631, 3,816,639, 3,869,621.

The disclosures and contents of the foregoing publication and patents of the prior art are incorporated herein by reference.

The grading of electrical insulations for higher voltage service produces a more even and effective distribution or pattern of electrical stresses through the overall mass or body of the dielectric insulating material containing the electrical conductor in accordance with the electrical stress phenomena and mechanisms of the foregoing prior art. That is, the stress or voltage gradation is distributed or extended to increase its magnitude within the body of the insulating medium without any increase at the surface of the insulation adjacent to the electrical conductor by means of one or more incremental increases in the specific inductive capacitance values within the body of dielectric insulation in the direction of the conductor.

Grading of the specific inductive capacitance (or permittivity) values progressively through a body or unit of electrical insulation can be accomplished by any one of several means of the prior art. For example, grading of insulations has heretofore been accomplished by varying the density of the paper or sheet wrapping in electrical cables wrapped in oil impregnated insulations, the use of sections or components of two or more materials having different specific inductive capacitance values in a composite insulating body, or by the selective incorporation of fillers into dielectric insulating materials, or portions thereof, to modify or regulate the specific inductive capacitance values of the material, or sections thereof, as determined by the value of the specific inductive capacitance of a particular filler composition, blends of fillers, or the amounts thereof introduced into the dielectric material.

However, contemporary insulated cable manufacturing techniques comprising continuous extrusion molding of plastic polymeric insulating materials, such as polyolefin compounds, about the cable conductor while passing through the extrusion molding apparatus, are not as accurate or controllable with respect to the transverse symmetrical and/or concentric formation of the body of insulation thereabout as some former system such as wrapping or rolling paper or other insulating material in sheet form around the central conductor.

Moreover, the degree or extent of a lack of symmetry and/or concentricity in cross-section of the extrusion formed insulated cable product is often accentuated with the current high speed plastic extrusion production operations and also with the sequential extrusion molding of multi-layers of components about the conductor in the formation of a composite body of plural layers of insulation surrounding the conductor for a graded cable.

Unsymmetrical, and/or non-concentric cross-sections of insulation in high voltage electrical cable having graded insulations are subject to uneven or disproportional electrical stresses, such as tangential stresses, at the interfaces between the adjoining components of the body of insulation having different dielectric properties or specific inductive capacitance values, which stresses in high voltage electrical transmission service of greater than about 69KV significantly contribute to or accelerate the breakdown of the insulation.

SUMMARY OF THE INVENTION

This invention comprises an improved electrical cable having stress graded insulations for high voltage electrical transmission service of at least about 69KV, which minimizes or overcomes the detrimental effects of uneven or disproportional electrical stresses at the interfaces intermediate sections of graded insulations that are attributable to a lack of cross-sectional symmetry or concentricity of the graded insulation and conductor. The invention includes insulated electrical cable of graded construction wherein the innermost layer or component of the graded insulation has the highest specific inductive capacitance (permittivity) of the overall or composite graded insulation, and the innermost layer and the adjoining contiguous layer or composite of the graded insulation, have specific inductive capacitance (permittivity) values within a ratio of less than 1.4. The invention is especially beneficial in the very high voltage service such as in cables used for 115KV and 138KV transmission.

OBJECTS OF THE INVENTION

It is the primary object of this invention to provide an improved graded insulation construction for high voltage carrying electrical cable which overcomes or minimizes uneven or disproportional electrical stresses within the graded insulation thereof.

It is also an object of this invention to provide a graded insulation which overcomes or compensates for uneven or disproportional electrical stresses resulting from unsymmetrical and/or non-concentric cross-sections of insulation in graded insulation cable structures, or variations therein.

It is a further object of this invention to provide a method of overcoming or minimizing the detrimental effects of uneven or tangential stresses at the interfaces intermediate the contiguous layers or components of the overall or composite graded insulations for electrical cables which are due to a lack of cross-sectional symmetry or concentricity in the graded insulation.

DESCRIPTION OF A PREFERRED EMBODIMENT

Figure 1:
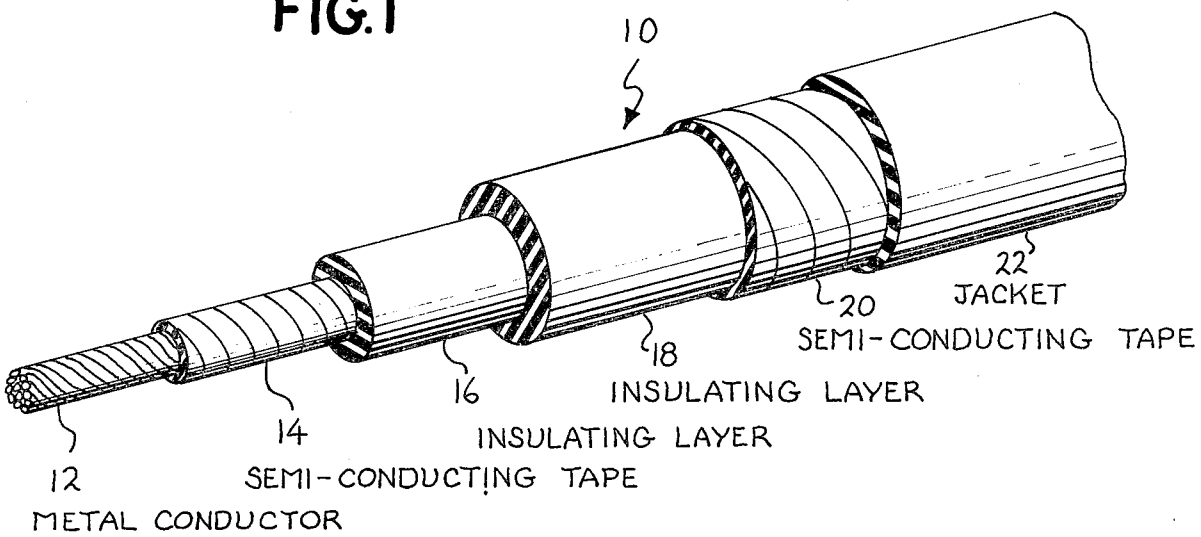
FIG. 1 is a perspective view of a graded cable constructed according to the present invention with portions of the different components thereof cut away for the purpose of illustration; and, FIG. 2 is a cross-sectional view of the cable construction of FIG. 1.
Figure 2:
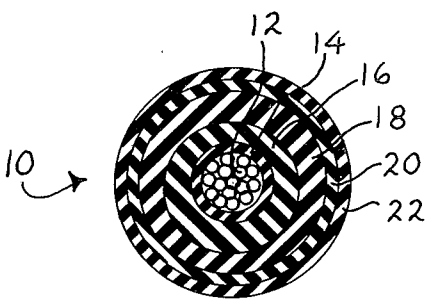

This invention comprises an improvement in insulated electrical cables of graded construction such as disclosed in U.S. Pat. No. 3,433,891, and certain other prior art identified hereinbefore, which resolves the adverse and detrimental effects of uneven or disproportional electrical stresses therein attributable to a commonly occurring defect resulting from contemporary production means, namely, a lack of cross-sectional symmetry and/or concentricity in the plural layers of the composite body of insulation surrounding the conductor in the product.

The improvement of this invention for minimizing disproportionate electrical stresses within the insulator, applies to insulated electrical cable products having a central metal electrical conductor surrounded by a graded composite insulation containing at least two distinct and contiguous layers of polymeric insulating material of different specific inductive capacitance values, and with the specific inductive capacitance values of the innermost layer of the composite graded insulation having the highest value, such as about 3.2 to about 3.8. The improvement is effected by the specific inductive capacitance value of the said innermost layer and of the next layer of the composite graded insulation contiguous to said innermost layer being provided in a ratio of less than 1.4, and in a preferred embodiment of the invention being within a ratio of about 1.2 to about 1.38.

This invention also specifically consists of the graded insulation of the improved cable product being constructed with the innermost layer or unit having the highest specific inductive capacitance value of the overall body of the graded insulation, being provided with a specific inductive capacitance value within the range of about 3.2 to about 3.8, and the outwardly adjacent layer or unit of the body of the graded insulation contiguous with said innermost layer, being provided with a specific inductive capacitance value with the range of about 2.2 to about 3.0. Additionally, the ratio of said preferred specific inductive capacitance values for the stated portions of the graded insulation must be less than 1.4, and preferably about 1.2 to about 1.38.

In accordance with this invention, the improved stress reducing graded insulations enclosing the conductor of the electrical cables, are composed of two, three or four contiguous layers or sections of polymeric material, or compounds thereof, wherein the predetermined specific inductive capacitance values, or ratios thereof, of the invention are provided therein by the apt selection of a polymeric material or materials on the basis of the dielectric characteristics thereof, and/or by the introduction of fillers into the polymeric insulating material which increase the specific inductive capacitance thereof. For example, the addition of fillers of a composition having a relatively high specific inductive capacitance value to a polymer having a lower specific inductive capacitance value. The use of fillers comprises the most convenient and effective means of regulating or achieving a particular specific inductive capacitance value within an insulating material because the value can be easily controlled or accurately varied within wide limits by means of the type or composition of the filler used, or the proportion thereof added.

Suitable polymeric insulating compositions for the practice of this invention comprise conventional polyolefin electrical insulating compounds such as disclosed in U.S. Pat. No. 3,433,891. Preferred polymer materials comprise ethylene-containing polymers including polyethylene, blends of polyethylene and other polymers, and copolymers of ethylene and other polymerizable materials such as ethylene-vinyl acetate and ethylene-propylene polymers. The polymeric materials or compounds thereof for the graded insulation of this invention include suitable conventional ingredients or additives such as clay fillers, pigments, processing aids, molding aids or release agents, lubricants, preservatives such as antioxidants or heat aging retardants, waterproofing agents, etc., in accordance with the prior art practices.

Moreover, it is highly preferred that the polymeric insulating materials employed in the practice of this invention be curable to a thermoset or thermal-mechanical stable state according to conventional means for providing a more heat resistant or thermally durable insulated cable product. Curing or polyolefins, such as those described above and commonly employed as electrical insulations to an effective thermoset condition can be achieved by means of a conventional cross-linking chemical reaction or mechanism induced by means of free radical forming peroxide curing agents or radiation. Suitable heat activated peroxide cross-link curing agents, and their use, are disclosed in U.S. Pat. Nos. 2,888,424; 3,079,370; 3,086,966; and 3,214,422, and include tertiary peroxides such as di-cumyl peroxide, and di-t-butyl peroxide.

The specific inductive capacitance value for any given polymeric material or composition thereof and of fillers can be determined from handbooks, or by testing samples of the particular material.

However, for purposes of illustration the specific inductive capacitance value for a typical cross-link cured polyethylene composition is about 2.25, and the same cured polyethylene containing about 50 parts by weight of clay filler per 100 parts of the polyethylene, which comprises an advantageous high voltage insulation composition, has a specific inductive capacitance value of about 2.8.

The modification or adjustment of specific inductive capacitances to attain a particular value or values in polymeric insulating materials, or compounds thereof, in accordance with the principle of this invention, can be most conveniently and accurately achieved in most instances by means of the addition of filler materials of relatively high specific inductive capacitance values and dispersion thereof therough the polymer material or compound. Specific inductive capacitance values of a body or mass of polymeric insulating material or compound can be precisely and uniformly governed therein by blending with fillers, or combinations of fillers, of appropriate specific inductive capacitance values and/or in apt amounts thereof.

However, for high voltage carrying cables such as above 69KV, wherein the adverse effects of uneven electrical stresses due to a lack of cross-sectional symmetry or concentricity of a graded insulation is most severe and distructive, the specific inductive capacitance of any component layer of the composite graded insulation should not exceed a value of about 5, and preferably not more than about 4.5, because materials or components of high specific inductive capacitance values cause excessive watt or power losses and the generation of high temperatures at such high voltages which are very detrimental to the integrity and performance life of the insulation. For example, note the comparison of specific inductive capacitance values of different insulating materials in an article entitled "A New Corona-and-Heat Resistant Cable Insulation Based On Ethylene Propylene Rubber" by Blodgett and Fisher, pages 980 and 981 of Paper 63-162, published December, 1963 by the AIEE.

Likely filler materials suitable for modifying and regulating the specific inductive capacitance values of polymeric insulations in the practice of this invention of overcoming the disproportionate electrical stresses in graded insulations resulting from an unsymmetrical and/or non-concentric structure, comprise, for example:

| FILLER | SIC |
|---|---|
| Aluminum Oxide ($Al_2O_3$) | 7.4 |
| Tantalum Oxide ($Ta_2O_5$) | 11.6 |
| Antimony Oxide ($Sb_2O_3$) | 9.9 |
| Zirconium Oxide ($ZnO_2$) | 12.4 |
| Tungsten Oxide ($WO_3$) | 17.8 |
| Titanium Dioxide-Rutile ($TiO_2$) | 114.0 |
| Titanium Dioxide-Anatase ($TiO_2$) | 48.0 |
| Barium Titanate ($BaTiO_2$) | 1000-10,000 |
| Magnesium Titanate ($MgTiO_2$) | 13-14 |
| Calcium Titanate ($CaTiO_2$) | 150-160 |
| Strontium Titanate ($SrTiO_2$) | 232 |

Referring to the drawing, there is illustrated a typical construction for an electrical cable with a graded insulation, and to which the improvement of this invention applies. Electrical cable 10, comprises a metallic conductor 12, which may consist of a single strand, or a plurality of strands as illustrated, a layer or wrap of semiconducting material 14, the graded insulation composed of two or more contiguous layers such as 16 and 18 of dielectric insulation, an overlying layer or wrap of semiconducting material 20, and an enclosing sheath or jacket 22. Electrical cables of this type also typically include an outer metallic conductor drain, which is not shown in the drawing.

The graded insulation which encloses the electrical conductor, as is conventional in this type of construction, comprises an innermost layer or unit 16 of dielectric insulation having the highest specific inductive capacitance value, with each outwardly successive layer of the composite forming the graded insulation construction, such as layer or unit 18, having a progressively decreasing specific inductive capacitance value. For example, in the practice of this invention, the composition of layer 16 may have a specific inductive capacitance of about 3.6, and the composition of layer 18 a specific inductive capacitance of about 2.8, whereby the ratio of said values is about 1.3.

The graded insulation of both the prior art, and as improved by the application of this invention, can include one or two more additional units of different specific inductive capacitance values, in the requisite sequence, than the two layers 16 and 18 shown in the drawing. For example, a composite graded insulation made up of three or four contiguous layers or units with each of a progressively decreasing specific inductive capacitance value extending outward from the innermost layer or unit having the highest specific inductive capacitance. However, the ratio of the outwardly descending values of the specific inductive capacitance for any two contiguous layers or units should be less than 1.4, and preferably between about 1.2 and about 1.38, and the specific inductive capacitance value of any layer or unit of the composite of graded insulation should not exceed 5.

The following are examples of polymeric insulating compositions having specific inductive capacities which are suitable for the fabrication of a graded insulation in accordance with the principle of this invention. The compositions are all cross-link cured to a relatively stable thermomechanical or thermoset state by means of the peroxide curing agent.

EXAMPLE I

| | Parts By Weight |
|---|---|
| Polyethylene | 100 |
| Titanium Dioxide | 82 |
| Antioxidant-Flectol H, Monsanto (polydihydrotrimethylquinoline) | 1.75 |
| Vinyl Tris (2-methoxyethoxy) Silane | 2.46 |
| Di-cumyl Peroxide Curing Agent | 3.55 |

The cured product of the foregoing polymer compound when tested in a body 3/64 of an inch thick at 60Hz and 1KV, had a specific inductive capacitance value of 3.37 and a power factor of 0.20.

The following table shows the specific inductive capacitance values of a polymer composition with various fillers.

| | EXAMPLES | | | | | |
|---|---|---|---|---|---|---|
| COMPOSITION | II | III | IV | V | VI | VII |
| Parts By Weight | | | | | | |
| Polyethylene | 100 | 100 | 100 | 100 | 100 | 100 |
| Antioxidant | 1 | 1 | 1 | 1 | 1 | 1 |
| Peroxide Curing Agent | 3.55 | 3.55 | 3.55 | 3.55 | 3.55 | 3.55 |
| Zirconium Oxide ($ZrO_2$) | 100 | | | | | |
| Barium Titanate ($BaTiO_3$) | | 100 | | | | |
| Zirconium Silicate ($ZnSiO_4$) | | | 100 | | | |
| Barium Zirconate ($BaZrO_3$) | | | | 100 | | |
| Lead Titanate ($PbTiO_3$) | | | | | 100 | |
| Titanium Dioxide ($TiO_2$) | | | | | | 100 |
| Toluene Extract % | 3.4 | 3.4 | 3.3 | 3.5 | 3.4 | 3.2 |
| Room Temperature (slabs) | | | | | | |
| Volume Resistivity (ohm cm $\times 10^{12}$) | 2735 | 5027 | 4915 | 4375 | 5039 | 4843 |
| Percent Power Factor | 0.18 | 0.23 | 0.40 | 0.18 | 0.19 | 0.15 |
| Specific Inductive Capacitance | 3.01 | 3.75 | 3.00 | 3.15 | 3.18 | 3.67 |
| 80° C | | | | | | |
| Volume Resistivity (ohm cm $\times 10^{12}$) | 4974 | 5027 | 3930 | 5043 | 5068 | 4843 |
| Percent Power Factor | 0.90 | 0.76 | 0.98 | 0.84 | 0.24 | 0.44 |
| Specific Inductive Capacitance | 2.87 | 3.55 | 2.90 | 3.03 | 3.01 | 3.85 |
| 100° C | | | | | | |
| Volume Resistivity (ohm cm $\times 10^{12}$) | 4958 | 5027 | 3773 | 4448 | 5068 | 3228 |
| Percent Power Factor | 0.83 | 0.44 | 1.37 | 1.35 | 0.35 | 0.77 |
| Specific Inductive Capacitance | 2.67 | 3.18 | 2.78 | 2.85 | 2.85 | 3.67 |

The following table illustrates the attributes of an electrical cable with a graded insulation according to the improvement of this invention where the innermost layer of the two phase graded insulation has a specific inductive capacitance of 3.6 and the subsequent contiguous layer of the two phase insulation has a specific inductive capacitance of 2.8 when subjected to stresses corresponding to those encountered in a typical 115KV cable. The volts per mill at the inner surface and also at the outer surface of the innermost layer 16 of the graded insulation, and at the inner surface and also at the outer surface of the contiguous outer layer 18 of the graded insulation are provided in the table. Two sets of data are supplied.

| Specific Inductive Capacitance | S1 Inner V/mil | S2 Interface V/mil | S3 Interface V/mil |
|---|---|---|---|
| 3.6 | 123.7 | 93.8 | 120.6 |
| 3.6 | 122.5 | 96.4 | 123.8 |

| S4 Outer V/mil | $l_1$ (mils) 1st Layer | $l_2$ (mils) 2nd Layer |
|---|---|---|
| 70.0 | 175 | 525 |
| 69.4 | 150 | 550 |

Although the invention has been described with reference to certain specific embodiments thereof, numerous modifications are possible and it is desired to cover all modifications falling within the spirit and scope of this invention.

What we claim as new and desire to secure by Letters Patent of the United States is:

1. An electrical cable for high voltage service having a multi-layered, graded insulation which minimizes uneven electrical stresses at the interface of insulation gradations, comprising an elongated metal electrical conductor enclosed within a surrounding composite body of polymeric insulation consisting of at least two distinct contiguous of polymeric insulation having different specific inductive capacitance values arranged about the electrical conductor with the innermost layer of polymeric insulation of the composite body of the insulation surrounding the electrical conductor having the highest specific inductive capacitance and each outwardly successive layer of polymeric insulation of the composite body of insulation having a progressively decreased specific inductive capacitance value, the specific inductive capacitance value of the innermost layer of polymeric insulation having the highest specific inductive capacitance surrounding the electrical conductor being about 3.2 to about 3.8 and the specific inductive capacitance value of the contiguous layer adjacent thereto being about 2.2 to about 3.0 and said specific inductive capacitance values being within a ratio of less than 1.4.

2. The electrical calbe of claim 1, wherein the specific inductive capacitance values of the innermost layer and of the contiguous layer adjacent thereto of the composite body of insulation are within a ratio of about 1.2 to about 1.38.

3. An electrical cable for high voltage service having a multi-layered, graded insulation which minimizes uneven electrical stresses at the interface of insulation gradations, comprising an elongated metal electrical conductor enclosed within a surrounding composite body of polymeric insulation consisting of two distinct contiguous layers of polymeric insulation having different specific inductive capacitance values arranged about the electrical conductor with the innermost layer of polymeric insulation of the composite body of the insulation surrounding the electrical conductor having the highest specific inductive capacitance and the outwardly successive layer of polymeric insulation of the composite body of insulation having a decreased specific inductive capacitance value, the specific inductive capacitance value of the innermost layer of polymeric insulation having the highest specific inductive capacitance surrounding the electrical conductor being about 3.2 to about 3.8 and the specific inductive capacitance value of the contiguous layer adjacent thereto being about 2.2 to about 3.0 and said specific inductive capacitance values being within a ratio of less than 1.4.

4. The electrical cable of claim 3, wherein the specific inductive capacitance values of the innermost layer and of the contiguous layer adjacent thereto of the composite body of insulation are within a ratio of about 1.2 to about 1.38.

5. An electrical cable for high voltage service having a multi-layered, graded insulation which minimizes uneven electrical stresses at the interface of insulation gradations, comprising an elongated metal electrical conductor enclosed within a surrounding composite body of polymeric insulation of at least one ethylene-containing polymer selected from the group consisting of polyethylene, blends of polyethylene and other polymers, and copolymers of ethylene and other polymerizable materials, and consisting of at least two distinct contiguous layers of said polymeric insulation having different specific inductive capacitance values arranged about the electrical conductor with the innermost layer of polymeric insulation of the composite body of the insulation surrounding the electrical conductor having the highest specific inductive capacitance and each outwardly successive layer of polymeric insulation of the composite body of insulation having a progressively decreased specific inductive capacitance value, the specific inductive capacitance value of the innermost layer of polymeric insulation having the highest specific inductive capacitance surrounding the electrical conductor being about 3.2 to about 3.8 and the specific inductive capacitance value of the contiguous layer adjacent thereto being about 2.2 to about 3.0 and said specific inductive capacitance values being within a ratio of less than 1.4.

6. The electrical cable of claim 5, wherein the specific inductive capacitance values of the innermost layer and of the contiguous layer adjacent thereto of the composite body of insultion are within the ratio of about 1.2 to about 1.38.

7. An electrical cable for high voltage service having an multu-layered, graded insulation which minimizes uneven electrical stresses at the interface of insulation gradations, comprising an elongated metal electrical conductor endlosed within a surrounding composite body of cross-link cured polymeric insulation of at least one ethylene-containing polymer selected from the group consisting of polyethylene, blends of polyethylene and other polymers, and copolymers of ethylene and other polymerizable materials, consisting of two distinct contiguous layers of said cured polymeric insulation having different specific inductive capacitance values arranged about the electrical conductor with the innermost layer of polymeric insulation of the composite body of the cured insulation surrounding the electrical conductor having the highest specific inductive capacitance and the outwardly successive layer of polymeric insulation of the composite body of insulation having a decreased specific inductive capacitance value, the specific inductive capacitance value of the innermost layer of polymeric insulation having the highest specific inductive capacitance surrounding the electrical conductor being about 3.2 to about 3.8 and the specific inductive capacitance value of the contiguous layer adjacent thereto being about 2.2 to about 3.0 and said specific capacitance values being within a ratio of less then 1.4.

8. The electrical cable of claim 7, wherein the specific inductive capacitance values of the innermost layer and of the contiguous layer adjacent thereto of the composite body of insulation are within a ratio of about 1.2 to about 1.38.

9. An electrical cable for high voltage electrical transmission service of at least about 69KV having a multi-layered, graded insulation which minimizes uneven electrical stresses at the interface of insulation gradiations, comprising an elongated metal electrical conductor enclosed within a surrounding composite body of cross-link cured polyethylene insulation consisting of at least two distinct contiguous layers of cured polyethylene insulation having different specific inductive capacitance values arranged about the electrical conductor with the innermost layer of polymeric insulation of the composite body of the polyethylene insulation surrounding the electrical conductor containing a filler and having the highest specific inductive capacitance and each outwardly successive layer of polymeric insulation of the composite body of insulation having a progressively decreased specific inductive capacitance value, the specific inductive capacitance value at the innermost filled layer of polymeric insulation having the highest specific inductive capacitance surrounding the electical conductor being about 3.2 to about 3.8 and the specific inductive capacitance value of the contiguous layer adjacent thereto being about 2.2 to about 3.0 and said specific inductive capacitance values being within a ratio of about 1.2 to about 1.38.

10. The electrical cable of claim 9, wherein the filler of the innermost layer having the highest specific inductive capacitance of the composite insulation is titanium dioxide.

11. A method of overcoming the detrimental effects of uneven electrical stresses at the interface of multi-layered, graded insulation in electrical cable for high voltage service comprising providing an elongated metal electrical conductor enclosed wihin a surrounding composite body of polymeric insulation consisting of at least two distinct contiguous layers of polymeric insulation having different specific inductive capacitance values arranged about the electrical conductor with the innermost layer of polymeric insulation of the composite body of insulation surrounding the electrical conductor having the highest specific inductive capacitance and each outwardly successive layer of polymeric insulation of the composite body of insulation having a progressively decreased specific inductive capacitance value, wherein said uneven stresses are attributable to a lack of crosssectional concentricity of the layers of graded insulation, comprising the steps of producing said innermost layer of polymeric insulation having the highest specific inductive capacitance of the composite insulation surrounding the electrical conductor with a specific inductive capacitance value of about 3.2 to about 3.8 and the contiguous layer adjacent thereto with a specific inductive capacitance value of about 2.2 to about 3.0 and with said specific inductive capacitance values in a ratio of less than 1.4.

12. The method of claim 11, wherein said innermost layer and the contiguous layer adjacent thereto at the composite polymeric insulation are produced with specific inductive capacitance values in a ratio of about 1.2 to about 1.38.

13. A method of overcoming the detrimental effects of uneven electrical stresses at the interface of multi-layered, graded insulation in electrical cable for high voltage service comprising providing an elongated metal electrical conductor enclosed within a surrounding composite body of polymeric insulation consisting of two distinct contiguous layers of polymeric insulation having different specific inductive capacitance values arranged about the electrical conductor with the innermost layer of polymeric insulation having the highest specific inductive capacitance and the outwardly successive layer of polymeric insulation of the composite body of insulation surrounding the electrical conductor having a decreased specific inductive capacitance value, wherein said uneven stresses are attributable to a lack of cross-sectional concentricity of the layers of graded insulation, comprising the steps of producing said innermost layer of polymeric insulation having the highest specific inductive capacitance of the composite insulation surrounding the electrical conductor with a specific inductive capacitance value of about 3.2 to about 3.8 and the contiguous layer adjacent thereto with a specific inductive capacitance value of about 2.2 to about 3.0 and with said specific inductive capacitance values in a ratio of less than 1.4.

14. The method of claim 13, wherein said innermost layer and the contiguous layer adjacent thereto of the composite polymeric indulation are produced with specific inductive capacitance values in a ratio of about 1.2 to about 1.38.

15. A method of overcoming the detrimental effects of uneven electrical stresses at the interface of multi-layered, graded insulation in electrical cable for high voltage service comprising providing an elongated metal electrical conductor enclosed within a surrounding composite body of polymeric insulation of at least one ethylene-containing polymer selected from the group consisting of polyethylene, blends of polyethylene and other polymers, and copolymers of ethylene and other polymerizable materials, and consisting of at least two distinct contiguous layers of said polymeric insulation having different specific inductive capacitance values arranged about the electrical conductor with the innermost layer of polymeric insulation of the composite body of the insulation surrounding the electrical conductor having the highest specific inductive capacitance and each outwardly successive layer of polymeric insulation of the composite body of insulation having a progressively decreased specific inductive capacitance value, wherein said uneven stresses are attributable to a lack of cross-sectional concentricity of the layers of graded insulations, comprising the steps of producing said innermost layer of polymeric insulation having the highest specific inductive capacitance of the composite insulation surrounding the electrical conductor with a specific inductive capacitance value of about 3.2 to about 3.8 and the contiguous layer adjacent thereto with a specific inductive capacitance value of about 2.2 to about 3.9 and with said specific inductive capacitance value in a ratio of less than 1.4.

16. The method of claim 15, wherein said innermost layer and the contiguous layer adjacent thereto of the composite polymeric insulation are produced with specific inductive capacitance values in a ratio of about 1.2 to about 1.38.

17. A method of overcoming the detrimental effects of uneven electrical stresses at the interface of multi-layered, graded insulation in electrical cable for high voltage service comprising providing an elongated metal conductor enclosed within a surrounding composite body of polymeric insulation of at least one ethylenecontaining polymer selected from the group consisting of polyethylene, blends of polyethylene and other polmers, and copolymers of ethylene and other polymerizable materials, consisting of two distinct contiguous layers of said polymeric insulation having different specific inductive capacitance values arranged about the electrical conductor with the innermost layer of polymeric insulation of the composite body of insulation surrounding the electrical conductor having the highest specific inductive capacitance and the outwardly successive layer of polymeric insulation of the composite body of insulation having a decreased specific inductive capacitance value, wherein said uneven stresses are attributable to a lack of cross-sectional concentricity of the layers of graded insulation, comprising the steps of producing said innermost layer of polymeric insulation having the highest specific inductive capacitance of the composite insulation surrounding the electrical conductor with a specific inductive capacitance value of about 3.2 to about 3.8 and the contiguous layer adjacent thereto with a specific inductive capacitance value of about 2.2 to about 3.0 and with said specific inductive capacitance values in a ratio of less than 1.4.

18. The method of claim 17, wherein said innermost layer and the contiguous layer adjacent thereto of the composite polymeric insulation are produced with specific inductive capacitance values in a ratio of about 1.2 to about 1.38.

19. A method of overcoming the detrimental effects of uneven electrical stresses at the interface of multi-layered, graded insulation in electrical cable for high voltage electrical transmission service of at least about 69KV comprising providing an elongated metal conductor enclosed within a surrounding composite body of cross-link cured polyethylene insulation consisting of at least two distinct contiguous layers of cured polyethylene insulation having different specific inductive capacitance values arranged about the electrical conductor with the innermost layer of polymeric insulation of the composite body of the polyethylene insulation surrounding the electrical conductor containing a filler and having the highest specific inductive capacitance and each outwardly successive layer of polymeric insulation of the composite body of insulation having a progressively decreased specific inductive capacitance value, wherein said uneven stresses are attributable to a lack of cross-sectional concentricity of the layers of graded insulation, comprising the steps of producing said innermost layer of polymeric insulation having the highest specific inductive capacitance of the composite insulation surrounding the electrical conductor with a specific inductive capacitance value of about 3.2 to about 3.8 and the specific inductive capacitance value of the contiguous layer adjacent thereto with a specific inductive capacitance value of about 2.2 to about 3.0 and with said specific inductive capacitance values in a ratio of about 1.2 to about 1.38.

20. The method of claim 19, wherein the filler of the innermost layer having the highest specific inductive capacitance of the composite insulation is titanium dioxide.

21. An electrical cable for high voltage electrical transmission service of at least about 69KV having a multi-layered, graded insulation, comprising an elongated metal electrical conductor enclosed within a surrounding composite body of polymeric insulation consisting of up to four distinct contiguous layers of polymeric insulation having different specific inductive capacitance values arranged about the electrical conductor with the innermost layer of polymeric insulation of the composite body of the insulation surrounding the electrical conductor having the highest specific inductive capacitance and each outwardly successive layer of polymeric insulation of the composite body of insulation having a progressively decreased specific inductive capacitance value, and wherein the specific inductive capacitance value of the innermost layer of polymeric insulation having the highest specific inductive capacitance of the polymeric insulation surrounding the electrical conductor is about 3.2 to about 3.8 and the specific inductive capacitance value of the contiguous relatively outward layer of polymeric insulation is about 2.2 to about 3.0, and said specific inductive capacitance values are in a ratio of less than 1.4.

22. The electrical cable of claim 21, wherein the specific inductive capacitance values of the inner layer and of the contiguous relatively outward layer of insulation are within a ratio of about 1.2 to about 1.38.

23. An electrical cable for high voltage electrical transmission service of at least about 69KV having a multi-layered, graded insulation, comprising an elongated metal electrical conductor enclosed within a surrounding composite body of polymeric insulation consisting of up to three distinct contiguous layers of polymeric insulation having different specific inductive capacitance values arranged about the electrical conductor with the innermost layer of polymeric insulation of the composite body of the insulation surrounding the electrical conductors having the highest specific inductive capacitance and each outwardly successive layer of polymeric insulation of the composite body of insulation having a progressively decreased specific inductive capacitance value, and wherein the specific inductive capacitance value of the innermost layer of polymeric insulation having the highest specific inductive capacitance of the polymeric insulation surrounding the electrical conductor is about 3.2 to about 3.8 and the specific inductive capacitance value of the contiguous relatively outward layer is about 2.2 to about 3.0, and said specific inductive capacitance values of said contiguous layers are in a ratio of less than 1.4.

24. The electrical cable of claim 23, wherein the specific inductive capacitance values of the inner layer and of the contiguous relatively outward layer of insulation are within a ratio of about 1.2 to about 1.38.

* * * * *

UNITED STATES PATENT AND TRADEMARK OFFICE

CERTIFICATE OF CORRECTION

PATENT NO. : 4,132,858

DATED : January 2, 1979

INVENTOR(S) : Harry C. Anderson et al

It is certified that error appears in the above-identified patent and that said Letters Patent are hereby corrected as shown below:

Claim 1, line 7, after "contiguous" insert --layers--.

Claim 2, line 1, "calbe" should be --cable--.

Signed and Sealed this

*Fourth* Day of *March 1980*

[SEAL]

*Attest:*

SIDNEY A. DIAMOND

*Attesting Officer*

*Commissioner of Patents and Trademarks*